US005625918A

United States Patent [19]

Kieson et al.

[11] Patent Number: 5,625,918

[45] Date of Patent: May 6, 1997

[54] MULTIPLE HEAD WRINGER MOP WITH TELESCOPING HANDLE

[75] Inventors: Gregory I. Kieson, Haddonfield; Anthony Lalli, Medford, both of N.J.

[73] Assignee: New Knight Inc., Paoli, Pa.

[21] Appl. No.: 616,927

[22] Filed: Mar. 15, 1996

[51] Int. Cl.[6] ..... A47L 13/146

[52] U.S. Cl. ..... 15/119.2; 15/144.4; 15/244.1

[58] Field of Search ..... 15/116.2, 119.2, 15/144.3, 144.4, 244.1

[56] References Cited

U.S. PATENT DOCUMENTS

| | | | |
|---|---|---|---|
| 1,185,732 | 6/1916 | Swayne | 15/144.4 |
| 1,406,841 | 2/1922 | Foss | 15/144.4 |
| 2,643,407 | 6/1953 | Vosbikian et al. | 15/119.2 |
| 2,757,398 | 8/1956 | Richards et al. | 15/119.2 |
| 2,883,689 | 4/1959 | Vosbikian et al. | 15/119.2 |
| 2,967,317 | 1/1961 | Richards | 15/119.2 |
| 3,806,982 | 4/1974 | Park | 15/244.1 X |
| 4,893,369 | 1/1990 | Johnson | 15/244.1 X |
| 5,483,720 | 1/1996 | Decoopman et al. | 15/244.1 X |

FOREIGN PATENT DOCUMENTS

| | | | |
|---|---|---|---|
| 1093146 | 5/1955 | France | 15/119.2 |
| 1226647 | 7/1960 | France | 15/116.2 |

*Primary Examiner*—Mark Spisich

*Attorney, Agent, or Firm*—Dann, Dorfman, Herrell and Skillman, P.C.

[57] ABSTRACT

An interchangeable head wringer mop with telescoping handle is provided. The device includes a handle and a mounting head. Rotatably connected to the mounting head is a wringer for wringing a sponge head. A plurality of interchangeable sponge heads having different configurations is provided. Each sponge head is removably connectable with the mounting head and is operable in connection with the wringer. Also provided are a pair of living hinges about which the sponge head bends during the wringing operation. Further, an extension telescoping within the handle is provided having two fixed positions.

17 Claims, 6 Drawing Sheets

MULTIPLE HEAD WRINGER MOP WITH TELESCOPING HANDLE

FIELD OF THE INVENTION

The present invention relates to wringing mops and, more particularly, to wringing mops adapted to utilize replaceable sponge heads.

BACKGROUND OF THE INVENTION

Wringing mops are well known in the art. Typically, wringing mops utilize a replaceable sponge head that can be thrown away when worn and replaced with a new one. The wringing mops with replaceable sponge heads that are known in the art provide limited utility because the sponge head is limited to a single configuration. Although different wringer mops may have differently configured sponge heads, the sponge head for each different mop is limited to a particular configuration to ensure that the sponge head operates with the respective mop wringer.

However, no one configuration for a mop head is flexible enough to meet the variety of cleaning tasks typically encountered in either a residential or commercial setting. Therefore, to accomplish all of the cleaning tasks, one must utilize a variety of separate cleaning devices.

The known wringing mops with replaceable heads generally have numerous separate mechanical parts used for mounting and wringing the sponge head. These various separate parts cause an increase in manufacturing costs as well as an increase in the cost of assembling the mop.

SUMMARY OF THE INVENTION

With the foregoing in mind, the present invention provides a novel wringing mop which has a plurality of interchangeable mop heads having various configurations. In this way, the configuration of the mop head can readily be changed to meet a variety of cleaning needs.

The present invention provides a wringer mop having an elongated handle with a mounting head connected to one end of the handle. Rotatably connected to the mounting head is a wringer that includes a wringer bracket and a plurality of rollers rotatably mounted on the wringer bracket. A plurality of interchangeable sponge heads are releasably connectable with the mounting head. These interchangeable sponge heads include a sponge head having a triangular configuration, a sponge head having a rectangular configuration, and a sponge head having a generally circular configuration.

The present invention further provides a wringer mop comprising an elongated handle and a mounting head fixably connected to one end of the handle. Releasably connectable with a mounting head is a sponge head comprising a resilient plastic sponge plate to which a sponge is fixedly attached. The sponge plate comprises a generally planar surface and two parallel living hinges for wringing the sponge. Each wringing hinge extends between two sides of the sponge plate so that the wringing hinges define the boundaries of three portions of the sponge plate. These three portions include a central portion between the two wringing hinges and two outbound wringer portions straddling the central portion.

A wringer is provided for wringing the sponge head. The wringer is rotatably connected to the mounting head and comprises a wringer bracket and a plurality of rollers rotatably mounted on the wringer bracket. The rollers are rotated on axles pivoted on the wringer mounts about a central axis so that when the sponge head is connected to the mounting head, the rollers engage flush against the surface of the sponge plate, so that the rollers straddle the central portion of the sponge plate. In this way, operation of the wringer causes the rollers to apply downward force on the sponge plate, which in turn causes the outbound wringer portions to rotate toward one another about the wringing hinges. The present invention further provides a wringer mop including an elongated tubular handle that is internally threaded at one end. A telescoping elongated extension is slidably displaceable within the handle. The extension has a first externally threaded portion adjacent one end of the extension, and a second externally threaded portion at the distal end of the extension. The two externally threaded portions have the same thread diameter and thread pitch as the internal threads of the handle. Fixedly connected to the other end of the handle is a mounting head. Rotatably connected to the mounting head is a wringer comprising a wringer bracket and a plurality of rollers rotatably mounted on the wringer bracket. Releasably connectable with the mounting head is one of a plurality of a sponge heads, each comprising a resilient sponge plate to which a sponge is fixedly attached.

BRIEF DESCRIPTION OF THE DRAWINGS

All of the objectives of the present invention are more fully set forth hereinafter with reference to the accompanying drawings, wherein.

DETAILED DESCRIPTION OF THE PREFERRED EMBODIMENTS

Figures 1, 2:
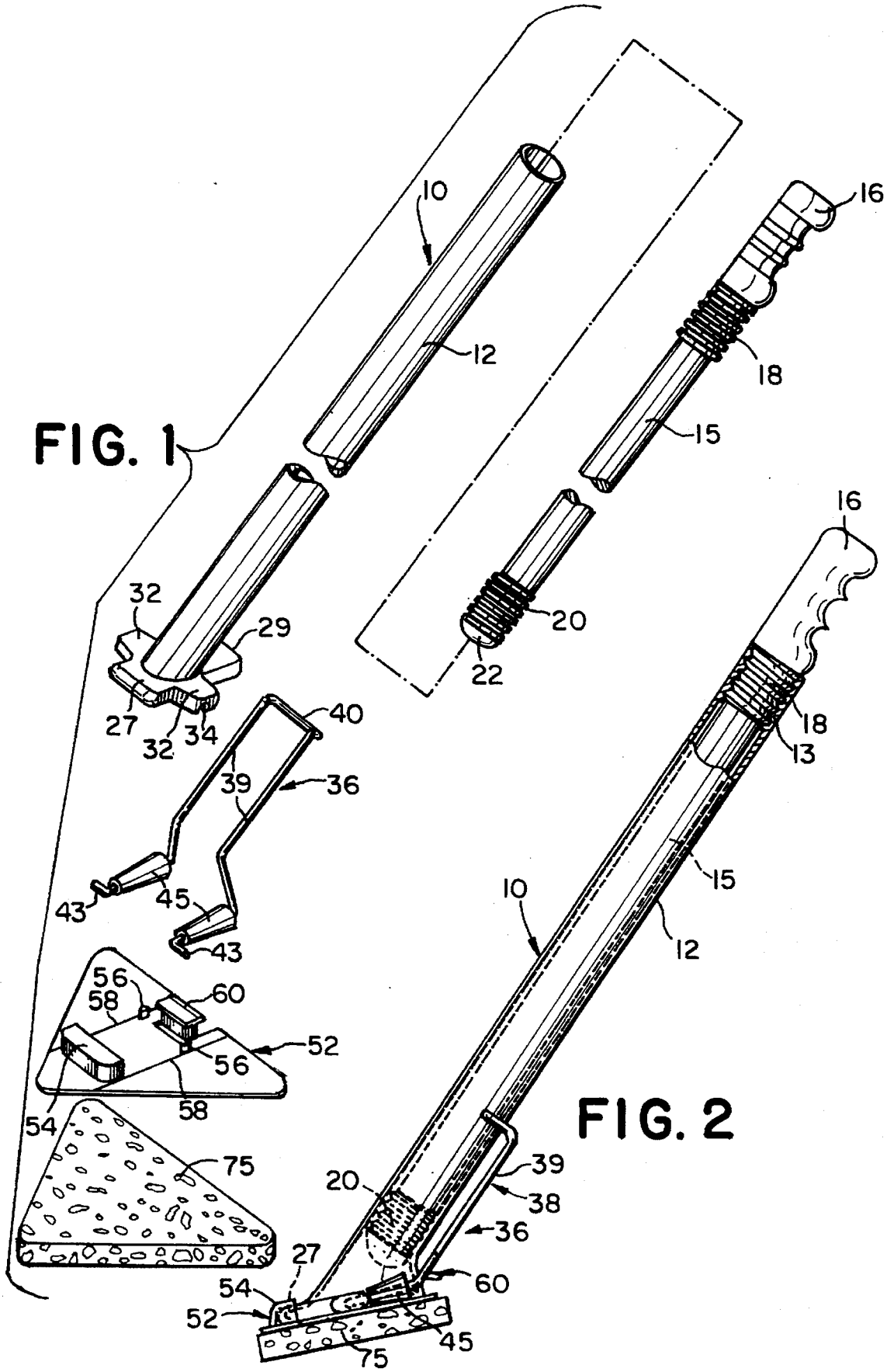
FIG. 1 is an exploded perspective view of a multiple head wringer mop with telescoping handle, manifesting aspects of the invention, illustrated with a triangular sponge head.
FIG. 2 is a side view of the device illustrated in FIG. 1 with portions broken away.

Referring now to the drawings generally and FIGS. 1–3 and 9–10 specifically, a multiple head wringing mop with telescoping handle 10 is illustrated. The mop has a handle 12, a telescoping extension 15, a wringer 36, and a sponge head, which includes a sponge plate 52 and a sponge 75.

As illustrated in FIGS. 1 and 2, the handle 12 is generally tubular having an internal threaded section 13 at one end and a mounting head 25 at the distal end. The mounting head 25 is preferably integral with the handle and is transverse the axis of the handle. The mounting head comprises a tongue 27, a foot 29 and two opposing wringer mounts 32. The wringer mounts are generally perpendicular to and in the same plane as the tongue and the foot. The tongue 27 and the foot 29 oppose one another and are releasably connectable with a sponge plate 52 as described below. The wringer 36 is mounted on the wringer mounts 32 as described below.

Preferably the handle 12 cooperates with the telescoping extension 15 as illustrated in FIGS. 1 and 2. The extension 15 is tubular, having a grip 16 at one end. The grip is configured to fit the hand of the operator using the wringer mop 10. Adjacent the grip 16, is an externally threaded portion 18 referred to as the upper threads. The extension also has a second externally threaded portion 20 at the distal end referred to as the lower threads. The lower threads have the same diameter and pitch as the upper threads 20.

In FIGS. 1 and 2 the thread length of the upper threads 18 and the lower threads 20 are approximately equal. However, preferably, the lower threads 20 are longer than the upper threads 18, preferably being at least twice as long as the upper threads 18. The diameter of the extension 15 including the upper and lower threads is less than the internal diameter of handle 12. Additionally, the thread diameter of the upper and lower threads is greater than the diameter of the extension 15 between the external threads 18, 20. This allows extension 15 to slidably extend or retract within handle 12.

In FIG. 2, extension 15 is shown in the retracted position within handle 12. The upper threads 18 of the extension 15 are screwed into the internal threaded portion 13 of the handle 12, thereby fixing the extension 15 in the retracted position. By unscrewing the upper threads 18 from the internal threads 13 of the handle 12, the extension 15 can be extended to increase the overall length of the wringer mop 10. The extension 15 can be fixed in the extended position by screwing the lower threads 20 into the internal threads 13 of the handle 12.

The lower threads 20 of the extension 15 cooperate with the internal threads 13 of the handle 12, so that the extension cannot readily overextend and become separated from the handle. The extension 15 can only be separated from the handle 12 by screwing the lower threads 20 through the internal threads 13 of the handle for the entire length of the lower threads 20. As an additional safeguard, a flared plug 22 may be connected to the distal end of the extension 15 to prevent separation of the extension from the handle. The plug 22 has a greater diameter than the diameter of the internal thread diameter of the threaded portion 13 of the handle 12, so that the lower threads 20 of the extension 15 cannot be screwed beyond the internal threads 13 of the handle 12. To facilitate attachment of the plug 22 after the extension 15 is assembled with the handle 12, the internal diameter of handle 12 preferably is accessible through the mounting head 25.

As previously noted, the mounting head 25 at the distal end of the handle 12 includes two opposing wringer mounts 32 onto which a wringer 36 is mounted. The wringer 36 comprises a wringer bracket 38 and a pair of rollers 45.

The wringer bracket 38 comprises two straight parallel arms 39 that straddle the handle 12. The straight arms are connected at one end by a semicircular portion that is curved to conform to the outer surface of the handle. Preferably, the curved portion is configured so that it can frictionally engage the handle 12. At the distal end of the straight arms 39, the bracket 38 diverges forming an angle in two planes with the straight arms 39. At the distal end of the diverging section, the bracket bends again, forming two generally parallel axles 42 onto which the rollers 45 are mounted. At the end of the roller arms, the mounting bracket bends transverse the roller arms 45 forming two mounting pins 43 that face away from one another.

The mounting pins 43 are used to mount the wringer bracket 38 on to the mounting head 25. Each of the wringer mounts 32 of the mounting head 25 has an opening 34 for receiving one of the mounting pins 43 of the wringer bracket. The openings are aligned to provide a central pivotal axis for the wringer bracket 38. The wringer bracket 38 is pivotally connected to the wringer mounts 32 by inserting the opposing mounting pins into the aligned openings 34 in the wringer mounts.

As noted above, a sponge head is mounted onto the tongue 27 and the foot 29 of the mounting head at the end of the handle 12. As shown in FIG. 1, the tongue 27 has a generally curved end profile, while the foot 29 has a generally square end profile.

Figure 3:
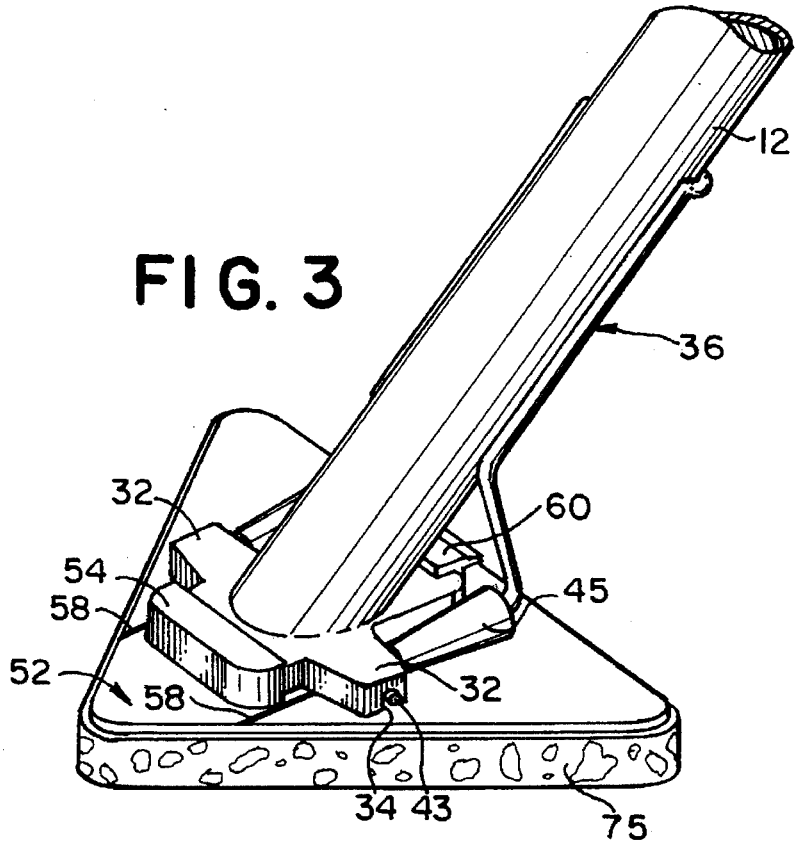
FIG. 3 is an enlarged fragmentary perspective view of the sponge head end of the device illustrated in FIG. 1.
Figure 4:
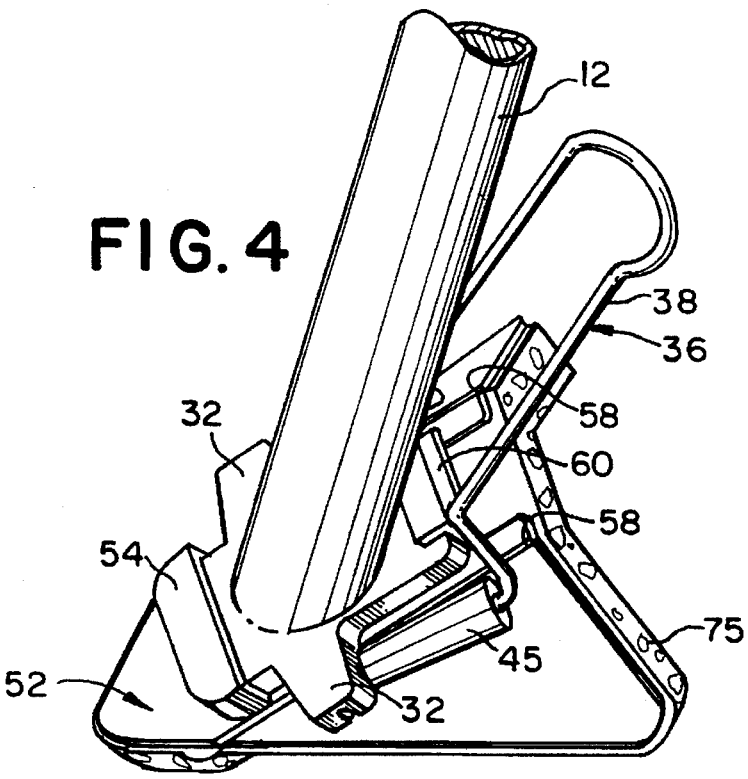
FIG. 4 is an enlarged fragmentary view of the sponge head end of the device illustrated in FIG. 1 with the wringer shown partially displacing the sponge head at the start of the wringing operation.
Figure 5:
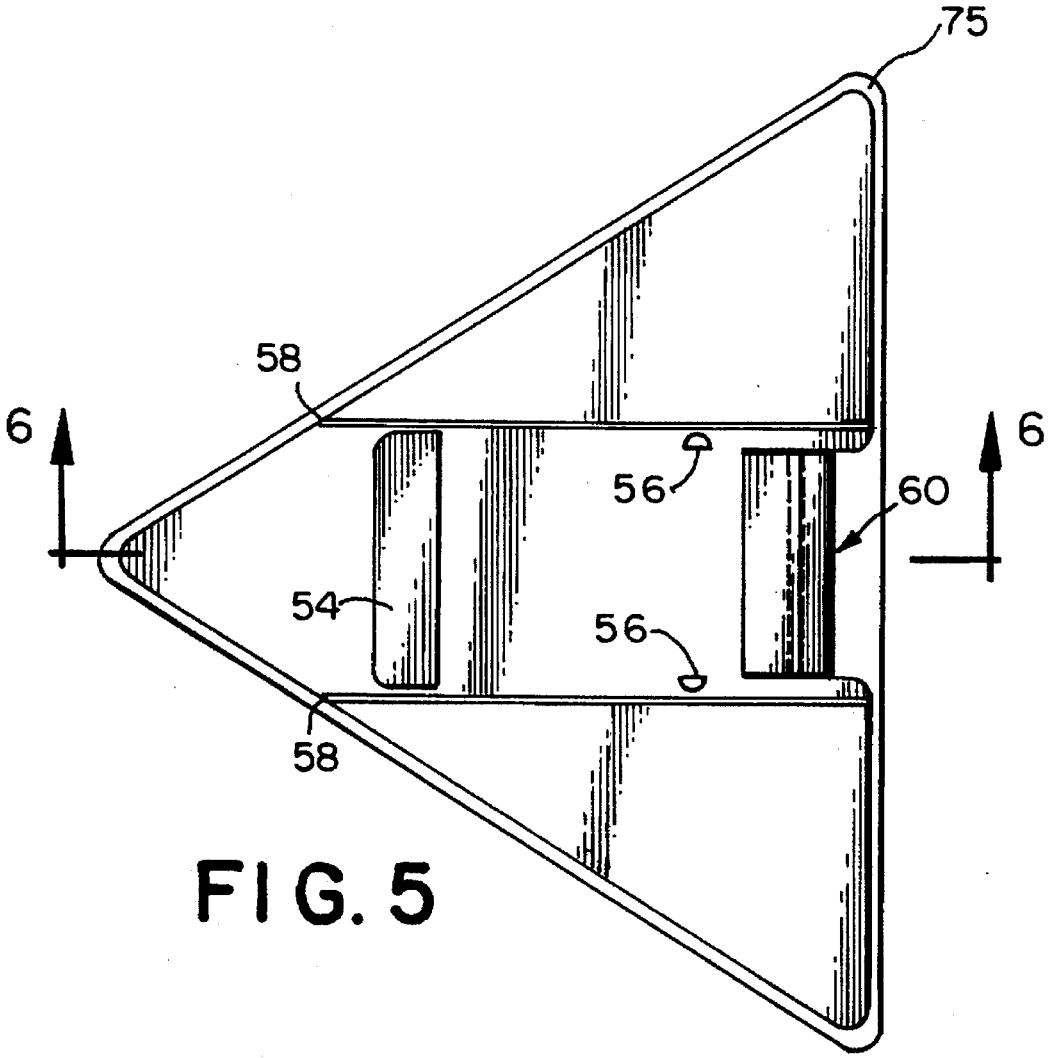
FIG. 5 is a top elevational view of the triangular sponge head shown in FIG. 1.
Figure 6:
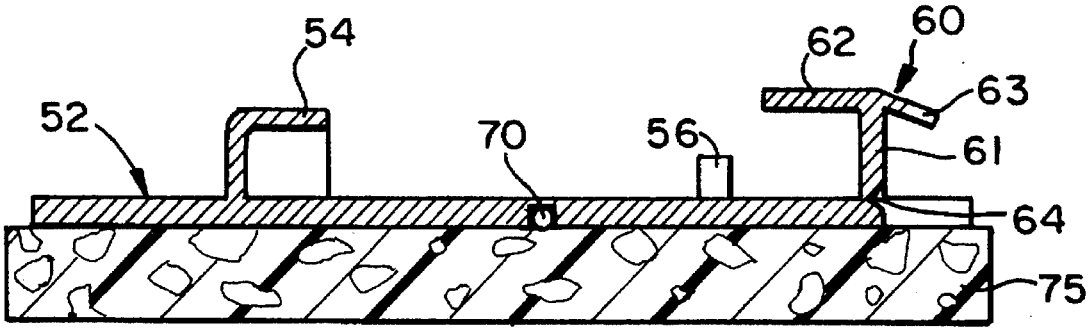
FIG. 6 is a transverse cross-sectional view of a triangular sponge head taken along line 6—6 of FIG. 5 having the thickness exaggerated for clarity.
Figure 7:
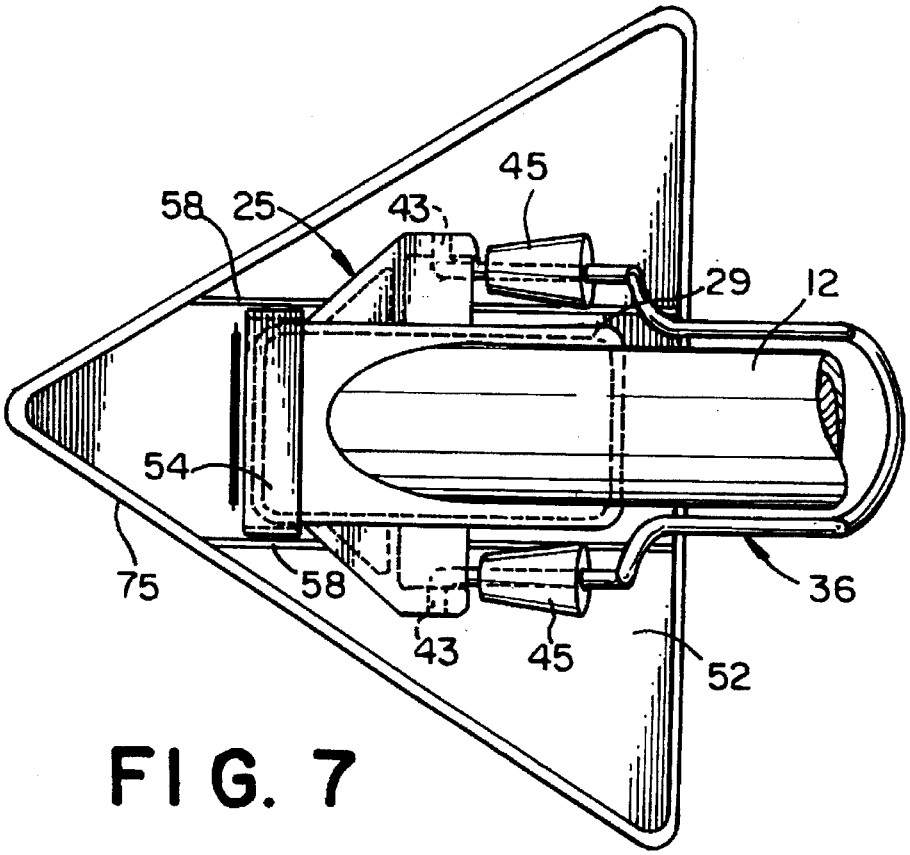
FIG. 7 is an enlarged top view of the sponge head end of the device shown in FIG. 1, with the handle being broken away.
Figure 8:
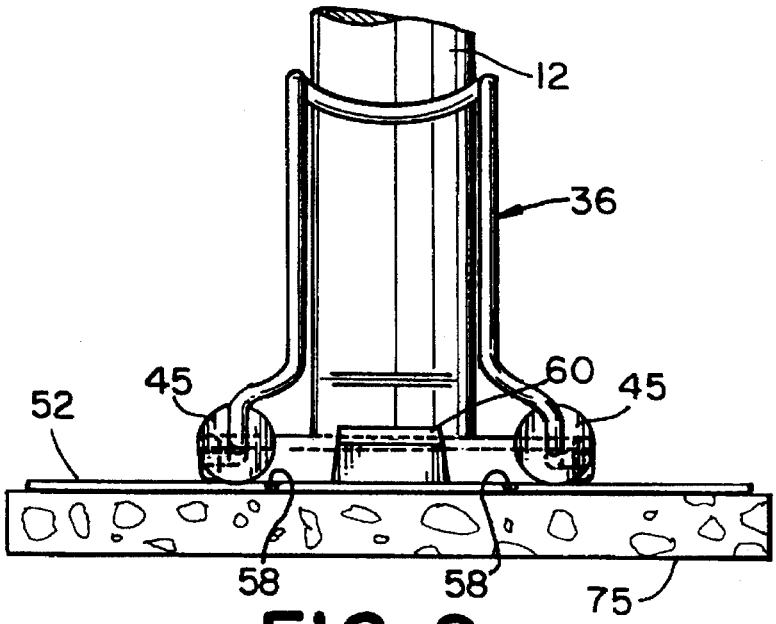
FIG. 8 is an enlarged side view of the sponge head end of the device illustrated in FIG. 1, with the handle being broken away.

The features of the sponge head are most readily observed in FIGS. 4–6. The sponge head includes two components, a sponge plate 52 and a sponge 75. The sponge is fixedly attached to the sponge plate. Preferably the sponge is permanently affixed to the sponge plate by means of a chemical adhesive. The surface of the sponge 75 that is attached to the sponge plate 52 is substantially similar in shape to the planar surface of the sponge plate. Additionally, the sponge is slightly larger than the sponge plate, so that the sponge overlaps the sponge plate as illustrated in FIG. 3.

A socket 54 projects from the surface of the sponge plate 52. The socket 54 is configured to cooperate with the tongue 27 of the mounting head 25. Opposing the socket 54 is a snap-release 60. The snap-release 60 is generally T-shaped in cross-section, having a web 61, a flange 62 and a thumb tab 63. The web 61 projects from the surface of the sponge plate 52, and the flange 62 and the thumb tab 63 extend transverse the web 61. The flange 62 extends toward the socket 54 generally perpendicular to the web 61. The thumb tab 63 extends away from the socket 54, preferably at an angle to the surface of the sponge plate 52.

A V-shaped groove extends along the intersection of the web 61 and the surface of the sponge plate 52. The sponge plate 52 is preferably fabricated from a resilient plastic, so that the groove 64 creates what is known in the art as a living hinge. The groove 64 is deep enough so that the snap-release will rotate about the groove 64 when downward pressure is applied to the thumb tab 63. However, the thickness of the web 61 is sufficiently thick so that the resilient release 60 returns to approximately its-original position when the downward force applied to the thumb tab 63 is removed.

Two grooves 58 in the surface of the sponge plate 52 straddle the handle socket 54 and the snap-release 60. The grooves 58 create a pair of living hinges for wringing the sponge 75. The wringing hinges 58 are preferably symmetric about the center line of the sponge plate 52, with one hinge extending from a first side on the triangular sponge plate to a second side, and the second hinge extending from the first side of the triangular sponge plate to a third side. The wringing hinges 58 are parallel and define three surfaces of the sponge plate 52: a central surface extending between the wringing hinges 58, and two outbound wringing surfaces straddling the central surface.

Adjacent the wringing hinges 58 and between the socket 54 and the snap-release 60, a pair of alignment posts 56 project from the surface of the sponge plate 52. The alignment posts 56 are preferably spaced apart a distance approximately equal to the width of the foot 29 of the mounting head 25. When the sponge head is connected to the mounting head 25, each mounting pin 56 confronts one of the sides of the foot 29 of the mounting head. Because the sides of the foot 29 are generally perpendicular to the surface of the sponge plate 52, the surfaces of the alignment posts 56 confronting the foot 29 are generally flat.

The sponge head is releasably mounted to the mounting head 25 as follows. The tongue 27 of the mounting head is inserted into the socket 54. The snap-release 60 is displaced by applying downward force to the thumb tab 63 of the snap-release so that the release rotates away from the socket 54. The displacement of the snap-release provides clearance for the mounting head 25 to seat flush against the sponge plate 52. Once the mounting head 25 is seated on the sponge plate, the downward force applied to the thumb tab 63 of the snap-release 60 is removed. By removing the downward force, the resiliency of living hinge 64 causes the snap-release 60 to return to its original position, thereby engaging the foot 29 of the mounting head 25. In this way, the socket 54 and the snap-release 60 cooperate with the tongue 27 and the foot 29 of the mounting head 25 to prevent longitudinal relative displacement between the sponge head and the mounting head. Additionally, the socket 54 and the aligning posts 56 cooperate with the tongue 27 and the foot 29 to prevent lateral relative displacement between the mounting head and the sponge head.

When the sponge head is mounted on the mounting head 25, the rollers 45 of the wringer 36 confront the surface of the sponge plate 52. Preferably, the rollers 45 straddle the center portion of the sponge plate 52 so that each roller confronts one of the wringing surfaces of the sponge plate.

The wringing operation of the mop 10 is illustrated in FIG. 4. To wring the mop, the operator applies downward force to the wringer bracket 38 so that the wringer bracket pivots away from the handle 12. The downward motion of the wringer bracket 38 forces the rollers 45 downward against the outbound wringing portions of the sponge plate 52. The wringing hinges 58 of the sponge plate 52 are the most flexible areas of the sponge plate surface, so that the downward force of the rollers 45 causes the surface plate and the sponge 75 of the outbound portions to pivot downward and toward each other about the wringing hinges 58.

The rollers 45 are preferably frustoconical. Additionally, the wringer 36 is preferably mounted on the mounting head 25 so that the axles 42 of the rollers are approximately parallel to the surface of the sponge plate 52 when the mop 10 is not being wrung as shown in FIG. 2. When the axles of the rollers are parallel to the surface of the sponge plate 52, the entire surface of each roller 45 does not contact the sponge plate 52. Instead, during the wringing operation, the largest diameter of each roller 45 initially contacts the surface of the sponge plate 52. As the wringing operation progresses, more of the roller surface contacts the surface of the sponge plate 52, so that by the end of the wringing operation the entire length of the rollers is in contact with the sponge plate. In this way, compared to cylindrical rollers, the frustoconical rollers require less force to be applied to the wringer bracket 38 to overcome inertia and initiate the wringing operation. Once the inertia of initiating the wringing operation is overcome, the momentum created will aid in the wringing operation as the rollers progressively come in greater contact with the surface of sponge plate 52.

Once the wringing operation is completed, the operator pivots the wringer bracket 38 in the reverse direction until the wringer bracket again frictionally engages the handle 12 as illustrated in FIG. 2. The resiliency of the sponge plate 52 causes the wringing surfaces of the sponge plate to return to their original position, so that the sponge head is again flat as illustrated in FIG. 3. To aid the elastic return of the wringing surfaces to the flat position, a piece of spring wire 70 may be connected to the sponge plate 52 as illustrated in FIG. 6. The spring wire 70, which is exaggerated in size for clarity, extends along the sponge plate 52 transverse the wringing hinges 58. The spring wire 70, which is shown in a channel in the sponge plate 52, may alternatively be molded into the sponge plate so that the spring wire is embedded within the sponge plate.

Preferably the mop includes the handle with a mounting head having a mounting bracket, and a plurality of interchangeable sponge heads. FIGS. 9–12 illustrate two sponge heads that are interchangeable with the sponge head illustrated in FIGS. 1–9. The sponge heads illustrated in FIGS. 9–12 are configured differently from the sponge head in FIGS. 1–8 so that the wringing mop 10 can be utilized in a wider variety of cleaning situations.

Figure 9:
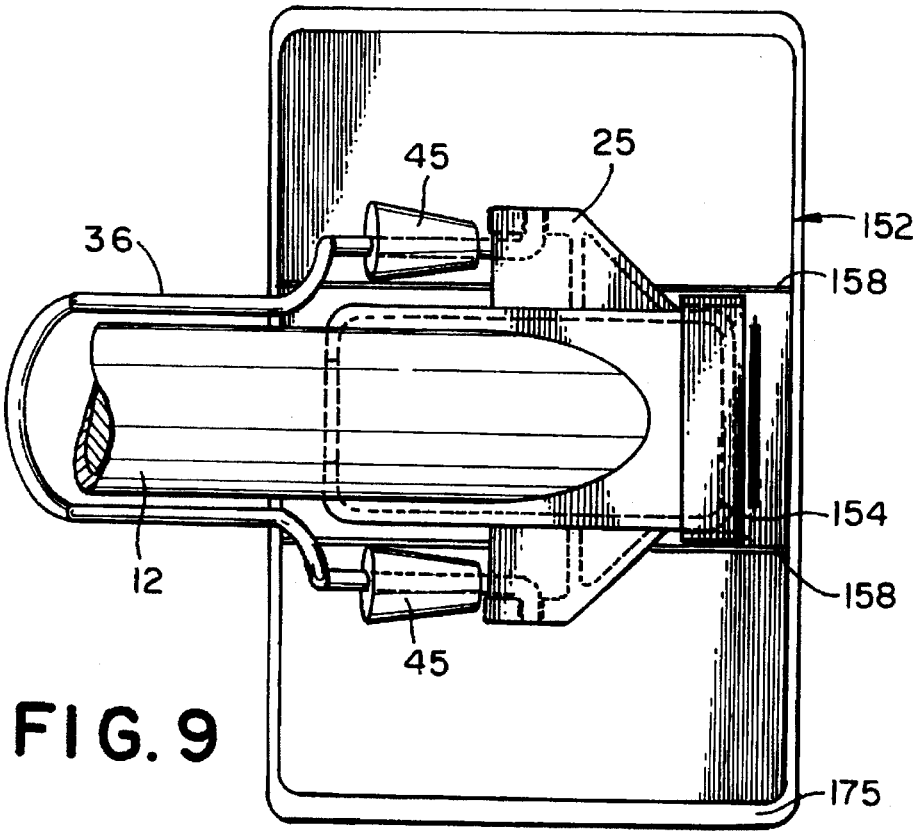
FIG. 9 is an enlarged top view showing the triangular sponge head illustrated in FIG. 1 replaced with a rectangular sponge head, with the handle being broken away.
Figure 11:
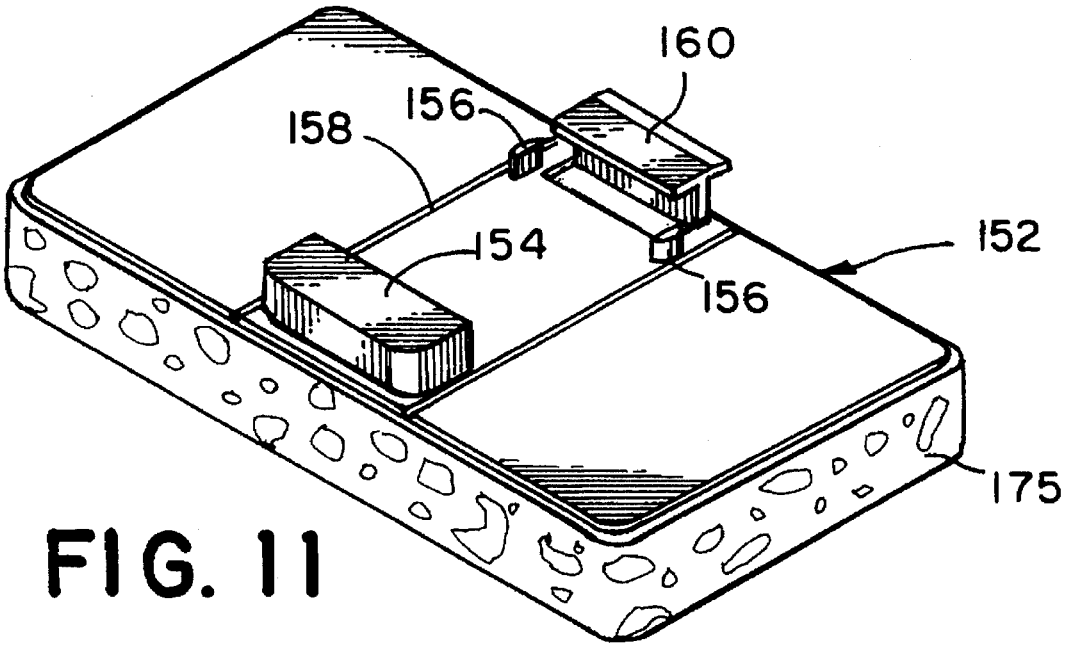
FIG. 11 is a perspective view of the rectangular sponge head illustrated in FIG. 9.

The mop head illustrated in FIGS. 9 and 11 is rectangular in shape, and includes a sponge plate 152 and a sponge 175. To provide interchangeability with the wringer 36, the sponge plate 152 of the rectangular sponge head is similar to the sponge plate 52 of the triangular sponge head illustrated in FIGS. 1–8. Specifically, the rectangular sponge head has a socket 154, a pair of mounting posts 156 and a snap-release 160 that are substantially the same as the socket 54, mounting posts 56 and snap-release 60 of the triangular sponge head. Additionally, the rectangular sponge head has a pair of wringing hinges 158 that are living hinges. The wringing hinges 158 define a central surface of the sponge plate 152 that is substantially the same in width as the central surface of the triangular sponge head.

Figure 10:
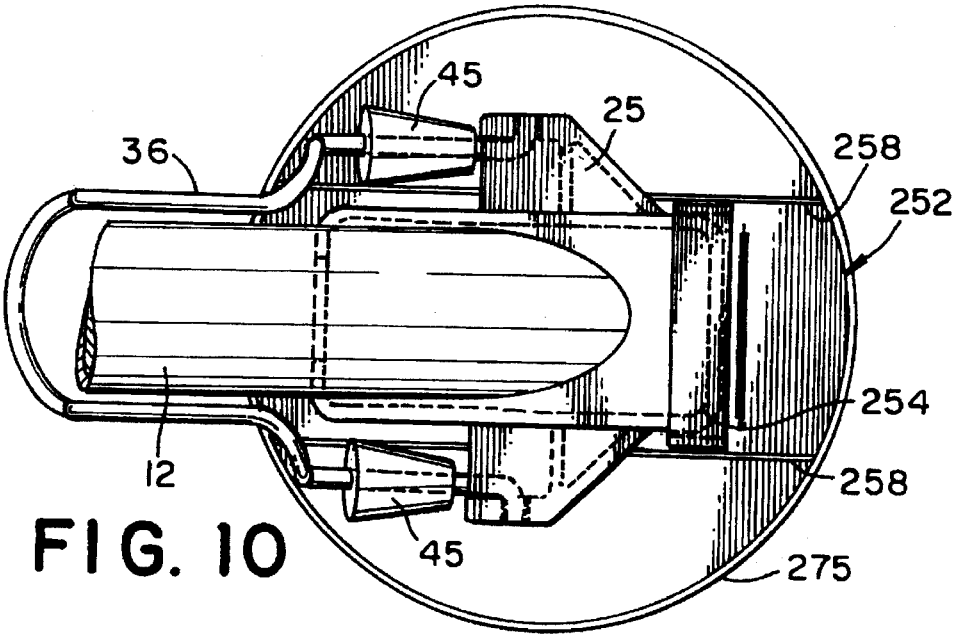
FIG. 10 is an enlarged top view showing the triangular sponge head illustrated in FIG. 1 replaced with a circular sponge head, with the handle being broken away.
Figure 12:
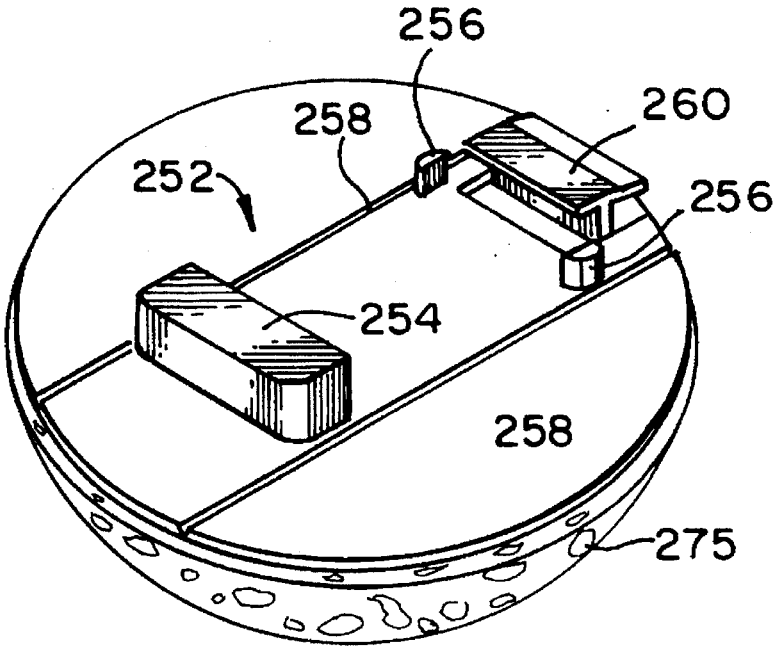
FIG. 12 is a perspective view of the circular sponge head illustrated in FIG. 10.

The mop head illustrated in FIGS. 10 and 12 is circular in shape, and includes a sponge plate 252 and a sponge 275. The sponge 275 is generally bulbous. To provide interchangeability with the wringer 36, the sponge plate 252 of the circular sponge head is similar to the sponge plate 52 of the triangular sponge head illustrated in FIGS. 1–8. Specifically, the circular sponge head has a socket 254, a pair of mounting posts 256 and a snap-release 260 that are substantially the same as the socket 54, mounting posts 56 and snap-release 60 of the triangular sponge head. Additionally, the circular sponge head has a pair of wringing hinges 258 that are living hinges. The wringing hinges 258 define a central surface of the sponge plate 252 that is substantially the same in width as the central surface of the triangular sponge head.

Some of the many novel features and advantages of the present invention are now apparent in view of the foregoing description. For example, a wringing mop has been described that includes a plurality of interchangeable removable sponge heads. Each of the interchangeable sponge heads is designed to work in conjunction with a single wringer. In this way, a single mop can be used with a plurality of differently configured sponge heads to meet a wide variety of cleaning needs. Additionally, to provide greater flexibility of use, a telescoping extension is provided. The extension has upper and lower external threads that cooperate with internal threads in the handle so that the extension can be fixed in either a retracted or extended position. Finally, the wringing has been simplified to eliminate various separate mechanical parts. In this way, several of the components of the wringer mop can be inexpensively produced as integral parts. For example, the sponge plate can be blow molded as an integral piece of plastic, as can be the mounting head and the handle. When produced in this manner, the parts are generally produced out of low melt polypropylene.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A wringer mop, comprising:

an elongated tubular handle internally threaded at one end;

an elongated extension slidably displaceable within the handle, comprising:

a first externally threaded portion adjacent one end of the extension;

a second externally threaded portion at the distal end of the extension, wherein the first and second threaded portions have the same thread diameter and thread pitch as the internal threads of the handle;

a mounting head fixedly connected to an end of the handle;

a wringer rotatably connected to the mounting head comprising:

a wringer bracket; and a plurality of rollers rotatably mounted on the wringer bracket; and a sponge head releasably connectable with the mounting head, comprising:

a resilient sponge plate having a generally planar surface; and a sponge fixedly attached to the sponge plate.

2. The wringer mop of claim 1, wherein the thread diameter of the first and second threaded portions of the extension is greater than the diameter of the extension between the first and second threaded portions, and the internal diameter of the non-threaded portion of the handle is greater than the thread diameter of the internal threads of the handle.

3. The wringer mop of claim 1, further comprising a grip adjacent the first externally threaded portion of the extension.

4. The wringer mop of claim 1, wherein the second externally threaded portion of the extension is longer than the first externally threaded portion of the extension.

5. The wringer mop of claim 4, wherein the second externally threaded portion is at least twice as long as the first externally threaded portion.

6. The wringer mop of claim 1, further comprising a plug at the distal end of the extension to prevent the handle from separating from the extension.

7. The wringer mop of claim 6, wherein the plug is flared with a maximum diameter greater than the thread diameter of the external threads and the tubular handle having a non-threaded portion with an internal diameter greater than the maximum diameter of the plug.

8. A wringer mop comprising:

an elongated handle;

a mounting head fixedly connected to an end of the handle;

a sponge head releasably connectable with the mounting head, comprising:

a resilient plastic sponge plate comprising:

a generally planar surface;

two parallel living hinges for wringing, each wringing hinge extending between two sides of the sponge plate, wherein the wringing hinges define the boundaries of three portions of the sponge plate, including a central portion between the two wringing hinges, and two outbound portions straddling the central portion; and a sponge fixedly attached to the sponge plate;

a wringer rotatably connected to the mounting head comprising:

a wringer bracket; and a plurality of rollers rotatably mounted on the wringer bracket, so that when the sponge head is connected to the mounting head, the rollers confront the surface of the outbound portions of the sponge plate, straddling the central portion of the sponge plate, wherein upon operation of the wringer, the rollers apply downward force on the sponge plate causing the outbound portions to rotate about the wringing hinges.

9. The wringer mop of claim 8, wherein the rollers are frustoconical.

10. The wringer mop of claim 9, wherein the rollers have axle portions mounted on the bracket for pivotal movement on a central axis, the central axis being generally parallel to the surface of the central portion of the sponge plate, causing the surfaces of the rollers to engage flush against the surfaces of the outbound portions.

11. The wringer mop of claim 8, wherein the sponge plate further comprises a socket, and a resilient snap release.

12. The wringer mop of claim 11, wherein the mounting head further comprises a tongue configured to cooperate with the socket, and a foot configured to cooperate with the snap release.

13. The wringer mop of claim 11, wherein the snap release is rotatable about a living hinge extending along the intersection of the snap release and the sponge plate.

14. A wringer mop comprising:

an elongated handle;

a mounting head fixedly connected to an end of the handle;

a wringer rotatably connected to the mounting head comprising:

a wringer bracket;

a plurality of rollers rotatably mounted on the wringer bracket;

a plurality of interchangeable sponge heads releasably connectable with the mounting head, including:

a sponge head having a triangular configuration comprising:

a resilient plastic sponge plate having a generally triangular planar surface;

a generally planar sponge having an upper surface fixedly attached to the sponge plate, wherein the upper surface of the sponge is substantially similarly shaped to the planar surface of the sponge plate;

a sponge head having a rectangular configuration comprising:

a resilient plastic sponge plate having a generally rectangular planar surface;

a generally planar sponge having an upper surface fixedly attached to the sponge plate, wherein the upper surface of the sponge is substantially similarly shaped to the planar surface of the sponge plate; and a sponge head having a generally circular configuration, comprising:

a resilient plastic sponge plate having a generally circular planar surface;

a bulbous sponge having an upper surface fixedly attached to the sponge plate, wherein the upper surface of the sponge is substantially similarly shaped to the planar surface of the sponge plate.

15. The wringer mop of claim 14, wherein the sponge plate further comprises a socket, and a resilient snap release.

16. The wringer mop of claim 15, wherein the mounting head further comprises a tongue configured to engage the socket, and a foot configured to engage the snap release.

17. The wringer mop of claim 15, wherein the snap release is rotatable about a living hinge extending along the intersection of the snap release and the sponge plate.

* * * * *